US005150554A

United States Patent [19]

Quinlan, Jr. et al.

[11] Patent Number: 5,150,554

[45] Date of Patent: Sep. 29, 1992

[54] PANEL-POST ARRANGEMENT

[75] Inventors: Roger J. Quinlan, Jr.; Stephen J. Simpson, both of Holland, Mich.

[73] Assignee: Haworth, Inc., Holland, Mich.

[21] Appl. No.: 630,036

[22] Filed: Dec. 19, 1990

[51] Int. Cl.[5] ..... E04B 1/00; E04F 17/08

[52] U.S. Cl. ..... 52/282; 52/28; 52/221; 52/731; 52/239; 160/351

[58] Field of Search ..... 52/281, 282, 275, 277, 52/239, 236.2, 582, 28, 221, 731; 160/351, 135

[56] References Cited

U.S. PATENT DOCUMENTS

| | | | |
|---|---|---|---|
| 3,603,052 | 9/1971 | Novoa | 52/281 X |
| 3,821,868 | 7/1974 | Edwards | 52/282 X |
| 3,866,381 | 2/1974 | Eschbach et al. | 52/282 X |
| 3,990,204 | 11/1976 | Haworth et al. . | |

FOREIGN PATENT DOCUMENTS

| | | | |
|---|---|---|---|
| 0244039 | 12/1965 | Austria | 52/281 |

OTHER PUBLICATIONS

"Supapole 7" brochure, Feb. 1988, Rolfe King Ltd.

1989 Steelcase Inc. brochure (2 pages from brochure).

*Primary Examiner*—David A. Scherbel

*Assistant Examiner*—Robert Canfield

*Attorney, Agent, or Firm*—Flynn, Thiel, Boutell & Tanis

[57] ABSTRACT

The post arrangement has a cross section which is substantially greater than the panel thickness, and is adapted to partially telescope over the end of one or more panels. The post arrangement defines therein an inwardly opening slot which is vertically elongate so as to permit an end edge portion of the panel to project therein. The slot can accommodate the end edge of a single panel or can be of sufficient angular extent to accommodate the end edge portions of two panels oriented in generally perpendicular relationship to one another.

14 Claims, 3 Drawing Sheets

PANEL-POST ARRANGEMENT

FIELD OF THE INVENTION

This invention relates to an upright space divider system of the type formed from a plurality of joined upright wall panels, such system being used for dividing large interior office spaces into smaller spaces, and in particular to an improved post assembly which cooperates with one or more of the wall panels.

BACKGROUND OF THE INVENTION

Upright space systems formed from a plurality of series-connected wall panels are extensively utilized in offices and the like for dividing large interior spaces into smaller work areas. Such space divider systems typically employ individual upright wall panels which have adjacent vertical edges thereof either fixedly or hingedly joined together. In some such systems, the vertical end edges of adjacent panels are substantially directly connected together, such as through an intermediate hinge or other suitable vertical spline which provides either a fixed or horizontally hinged relationship. In other such systems, adjacent panels are interconnected through intermediate upright posts which typically provide vertical support for the wall panels and hence either fixedly or hingedly connect to the vertical edges of the adjacent panels. In systems of this latter type, the intermediate posts typically have a maximum width or diameter which substantially corresponds to the panel thickness. The posts thus function primarily for supporting the panels in an upright position, and as such are typically provided with minimum cross-sectional dimensions to minimize the effect thereof on the overall visual aspects of the system, and are disposed adjacent and outwardly of the vertical end edge of the panel and couple directly thereto.

Accordingly, it is an object of this invention to provide an upright space divider system which typically involves panels which directly serially connect to one another either fixedly or hingedly, but wherein the system is additionally provided with an improved post arrangement which can cooperate with the wall panel system to provide additional functional characteristics. More specifically, the improved post arrangement preferably has a cross section which is substantially greater than the panel thickness, and in addition is adapted to partially telescope over the end of one or more panels. The post arrangement defines therein an inwardly opening slot which is vertically elongate so as to permit an end edge portion of the panel to project therein. The slot can accommodate the end edge of a single panel or can be of sufficient angular extent to accommodate the end edge portions of two panels oriented in generally perpendicular relationship to one another.

In the improved wall system of this invention, the post arrangement is defined by a plurality of vertically elongate post segments which individually define only a part of the peripheral extent of the post. The post segments have opposed flanges which accommodate securing elements to permit the post segments to be fixedly locked together to create a generally hollow post, preferably of circular cross section. The post segments also have inwardly projecting cantilevered flanges which cooperate with the edge of the wall panel which projects into the slot so that a vertically elongate securing element can be coupled between the wall panel edge and one of the inwardly project securing flanges.

Other objects and purposes of the present invention will be apparent to persons familiar with structures of this general type upon reading the following specification and inspecting the accompanying drawings.

Figure 1:
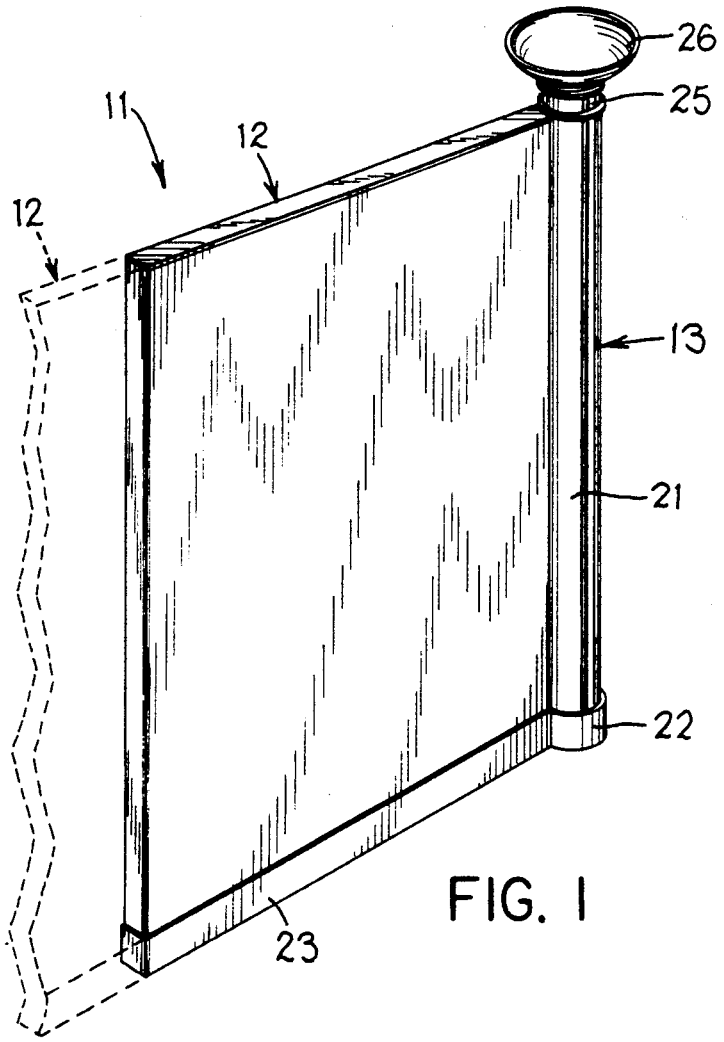
FIG. 1 is a perspective view which illustrates a wall system according to the present invention, and particularly illustrates a single panel disposed with a vertical edge portion thereof engaged with an upright post assembly.

Certain terminology will be used in the following description for convenience in reference only, and will not be limiting. For example, the words "upwardly", "downwardly", "rightwardly" and "leftwardly" will refer to directions in the drawings to which reference is made. The word "upwardly", will also be used in reference to the normal vertical orientation of the panel and post. The words "inwardly" and "outwardly" will refer to directions respectively toward and away from the geometric center of the panel or post and designated parts thereof. Said terminology will include the words specifically mentioned, derivatives thereof, and words of similar import.

DETAILED DESCRIPTION

Referring to FIG. 1, there is illustrated a fragmentary portion of an upright space divider system 11 of the type used in offices and the like for dividing large areas into smaller working areas. The system 11 includes a plurality of upright wall panels 12 (only one shown in solid lines in FIG. 1), which panels are typically of generally rectangular profile and are adapted to be disposed in selected orientations, such as typically in aligned or perpendicular relationship. FIG. 1 illustrates two such panels 12 in generally aligned relationship, and as is typical, the opposed vertical end edges of adjacent panels are suitably joined together by a rigid or hinge structure.

In the present invention, the panels 12 are typically provided with edge rails 14 extending vertically along the ends thereof, which edge rails 14 have a pair of undercut slots 15 formed therein adjacent opposite sides thereof, which slots project vertically throughout substantially the full height of the panel. These slots 15 are designed to accommodate part of a connecting or securing element 16 therein, which element in effect constitutes a vertically elongate hinge strip. This connector 16 includes a pair of vertically elongate hinge plate 17 joined along one edge by a hinge 18 (namely a plastic or "living" hinge), and each hinge plate 17 has a generally L or T-shaped part 19 projecting outwardly from one side thereof. The connector or hinge strip 16 is adapted to join adjacent vertical edges of two panels 12 together, such being accommodated by inserting the part 19 into one of the grooves 15 on one panel, and by inserting the other part 19 into an opposed groove 15 formed on the edge of an adjacent panel. The structure of the connector or hinge strip 16, and its manner of connection between adjacent panels, is conventional so that further description is believed unnecessary. Reference is also made to U.S. Pat. No. 3,990,204 which illustrates and describes this hinge strip and its connection between adjacent panels in greater detail.

Figure 2:
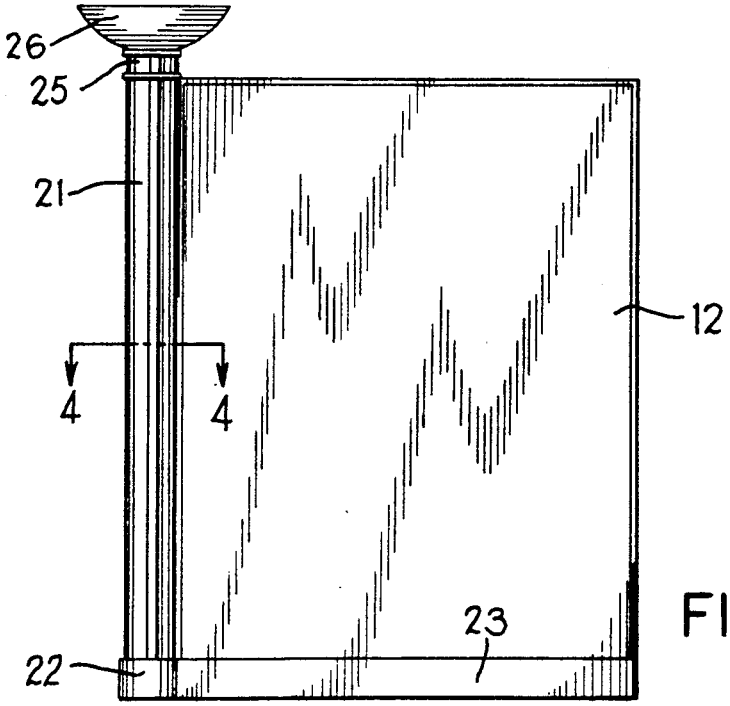
FIG. 2 is a reversely-oriented side elevational view of the arrangement shown in FIG. 1.

The wall system 11 of the present invention, as illustrated by FIGS. 1 and 2, also induce an upright post assembly 13 which, in the arrangement illustrated by FIGS. 1 and 2, cooperates with the end edge of a single panel, namely a free end edge of the panel 12.

Figure 3:
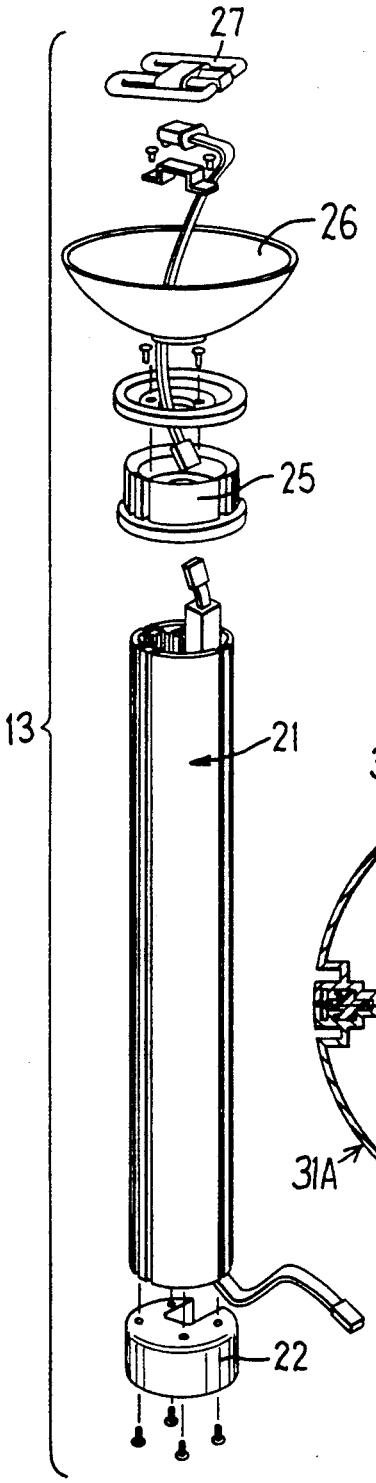
FIG. 3 is an exploded perspective view of the post assembly.

As illustrated by FIG. 3, the post assembly 13 includes a generally hollow upright cylindrical post 21 which, at its lower end, is fixedly secured to a generally cylindrical support or base member 22, the latter being of small vertical height and having a vertical height generally corresponding to the height of the panel base 23 so as to be compatible therewith. The hollow or tubular post 21 projects upwardly throughout the full height of the panel. The upper end of post 21 bears against a generally cylindrical cap 25 which projects upwardly through a small vertical extent above the upper edge of the wall panel. This cylindrical top cap 25 may, if desired, be provided with a suitable light fixture mounted thereon so as to project upwardly therefrom, and one illustration of such is shown by means of the upwardly-opening bowl-shaped reflector or diffuser 26, the latter being positioned in surrounding relationship to an electrified lighting element such as the small fluorescent light tube 27.

Figure 4:
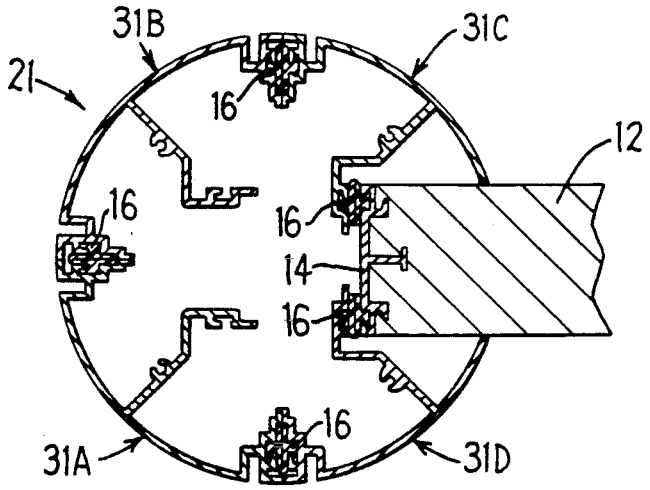
FIG. 4 is an enlarged, fragmentary sectional view taken substantially along line 4—4 in FIG. 2.
Figure 5:
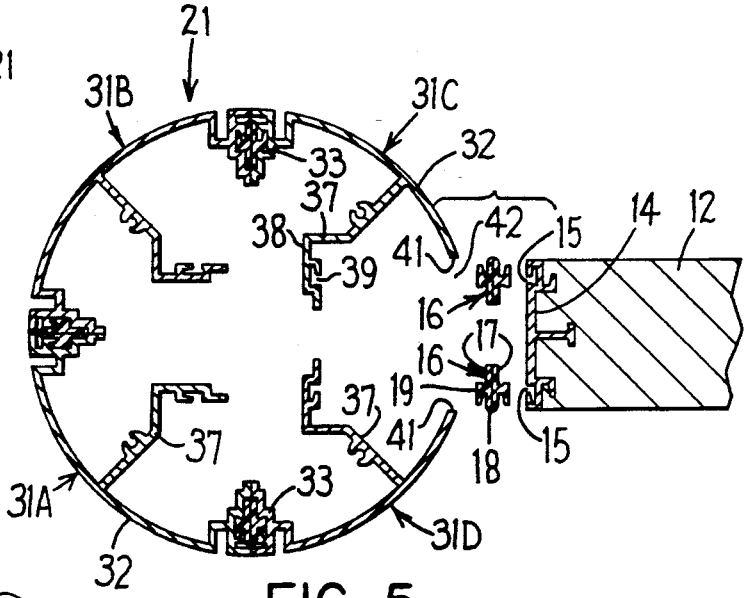
FIG. 5 is a view corresponding to FIG. 4 but showing the post and panel in a separated condition.
Figure 6:
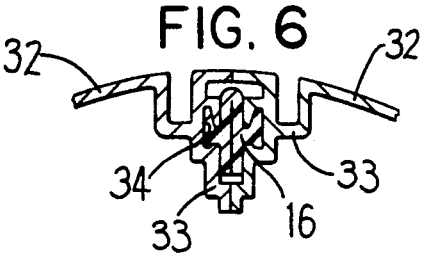
FIG. 6 is an enlarged fragment view of a portion of FIG. 5.

Considering now the structure of the hollow post 21, and referring to FIGS. 4 and 5, this post 21 is defined by a plurality of individual post elements 31, namely by four post elements 31A, 31B, 31C, 31D in the embodiment of FIGS. 1-5.

As to the structure of the post elements or segments, and referring specifically to the post segment 31A, it includes an arcuate peripheral wall segment 32 which preferably extends through an angular extent of about 90°. This arcuate peripheral wall segment 32, at the terminal vertical edges thereof, is fixedly and integrally joined to support flanges 33 which project generally radially inwardly from the arcuate wall segment toward the vertical centerline of the post. Each of the support flanges 33 has an undercut groove 34 formed therein and extending vertically throughout the length thereof. The groove 34 as associated with each flange 33 opens outwardly in a circumferential direction oriented generally away from the arcuate extent of the respective wall segment 32. Thus, the pair of undercut grooves 34 associated with the pair of support flanges 33 as defined on opposite edges of the wall segment 32 hence open generally outwardly in opposite directions with respect to one another relative to the circumferential extent of the post.

The post segment 31 also has a securing flange 37 which is fixedly secured to the peripheral wall segment 32, such as at the midpoint thereof in the illustrated embodiment. This flange 37 projects generally radially inwardly in cantilevered relationship from the wall segment 32. Securing flange 37 is, like the support flanges 32, vertically elongated so as to extend over substantially the full vertical extent of the arcuate wall segment 32.

Securing flange 37, adjacent the inner free end thereof, is provided with a flange portion 38 which projects horizontally so as to extend in generally horizontally parallel relationship to one of the support flanges 33. This flange portion 38 also defines therein an undercut groove 39 which extends vertically throughout the length thereof, with this groove 39 being identical to the grooves 34. Groove 39 as associated with flange portion 38 opens outwardly in the opposite direction from the groove 34 associated with the flange 33 which extends horizontally parallel with the flange portion 38.

The post segment 31B is identical to the post segment 31A and hence will not be described in detail. The post segments 31A and 31B can be disposed in circumferentially adjacent and abutting relationship, the latter being achieved by positioning the support flanges 33 in directly opposed and abutting engagement with one another. When in this latter relationship, the undercut grooves 34 defined in the opposed support flanges 33 communicate with one another and permit a securing rib or spline, specifically and preferably one of the connectors or hinge strip 16, to be slidably inserted therein so as to join the adjacent edges of the post segments 31A and 31B together.

Since each of the support flanges has radially inner and outer portions which abuttingly engage respective opposed portions on the other support flange, whereby the connector strip 16 is totally captivated therebetween, the connector strip 16 effectively creates a rigid securement between the adjacent abutting edges of the post segments 31A and 31B.

As illustrated by FIGS. 4 and 5, the securing flanges 37 associated with the post segments 31A and 31B are reversely oriented. This is merely by vertically rotating one of the post segments (such as 31B) 180° relative to the other post segment (such as 31A) and then securing adjacent post segments together since each post segment has identical support flanges 33 associated with each vertical edge thereof.

Referring now to the post segment 31C, it is substantially identical to the post segment 31A in many respects in that it again has an arcuate peripheral wall 32 provided with an identical support flange 33 along one vertical edge thereof, and a securing flange 37 project inwardly therefrom. However, the arcuate wall 32 of segment 31C is of lesser arcuate extent, namely being substantially less than 90° and preferably being more in the order of 60° to 75°, whereby the arcuate wall segment 32 of post segment 31C terminates at a free vertically-extending edge 41, which edge is not provided with a support flange 33 thereon.

The remaining post segment 31D is identical to the segment 31C in that the arcuate wall segment extends through an arcuate extent significantly less than 90° so as to terminate in a free edge 41. The segments 31C and 31D are identical but, in order to result in the securing flanges 37 thereof being reversely oriented as illustrated by FIG. 5, the one segment 31D is vertically rotated 180° relative to the other segment 31C.

With the segments 31C and 31D oriented as illustrated by FIG. 5, the support flange 33 along one edge of the segment 31C abuts the opposed support flange 33 on the segment 31B, and the connector strip 16 couples these opposed support flanges together to rigidly join the pole segment 31C to the adjacent pole segment 31B. The pole segment 31D is similarly rigidly joined to the adjacent pole segment 31A.

With the four segments joined as illustrated by FIG. 5, the four segments are all rigidly joined together to form a generally hollow tubular support post of circular cross section, and the opposed free edges 41 of the segments 31C and 31D are horizontally spaced apart so as to define therebetween a slotlike opening 42 which extends vertically throughout substantially the full length of the post and which opens inwardly into the open interior of the post. The horizontal width of this slotlike opening 42, namely the horizontal spacing between opposed edges 41, substantially corresponds to the thickness of a said panel 12 so as to permit a portion of the panel 12, adjacent one end edge thereof, to be inserted through the slot 42 partially into the interior of the post substantially as illustrated by FIG. 4.

With the edge portion of the panel 12 inserted through the slot 42 into the interior of the post, which insertion normally occurs through an extent which preferably is at least about one-half of the radius of the support post, the end rail 14 of the panel is disposed directly opposite the flange portions 38 associated with the post segments 31C and 31D. It should be noted that the flange portions 38 on the post segments 31C and 31D are oriented so that they are generally coplanar and project horizontally toward one another so that the free ends thereof are disposed in more closely adjacent relationship, whereby the grooves 39 open outwardly toward the slotlike opening 42. Thus, this results in the pair of grooves 15 as defined in the end rail 14 being disposed substantially directly opposite the pair of outwardly facing grooves 39. The panel 12 can then be rigidly secured with respect to the post by utilization of a pair of connector or hinge strips 16. More specifically, a hinge strip 16 is slidably inserted into each opposed pair of grooves 15 and 39, substantially as illustrated by FIG. 4, to thus fixedly secure the panel 12 and post 21 together.

With the post and panel rigidly assembled as illustrated by FIG. 4, the post 21 still defines therein a hollow interior of significant cross section, which hollow interior can be readily utilized to permit passage therethrough of electrical or communication cables, including cabling for the light which may optionally be mounted on the upper end of the post.

Figure 7:
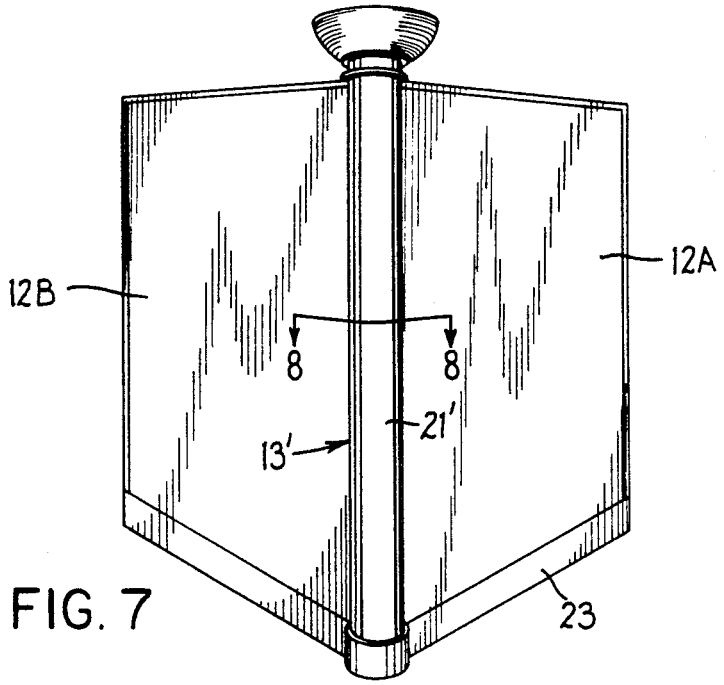
FIG. 7 is a perspective view illustrating a variation wherein the post cooperates with a corner as defined where two generally perpendicularly extending panels meet.
Figure 8:
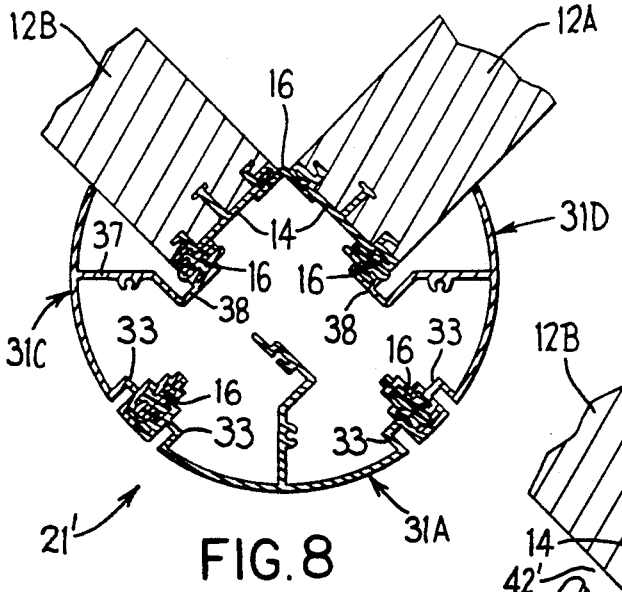
FIG. 8 is an enlarged fragmentary cross-sectional view taken substantially along line 8—8 in FIG. 7.
Figure 9:
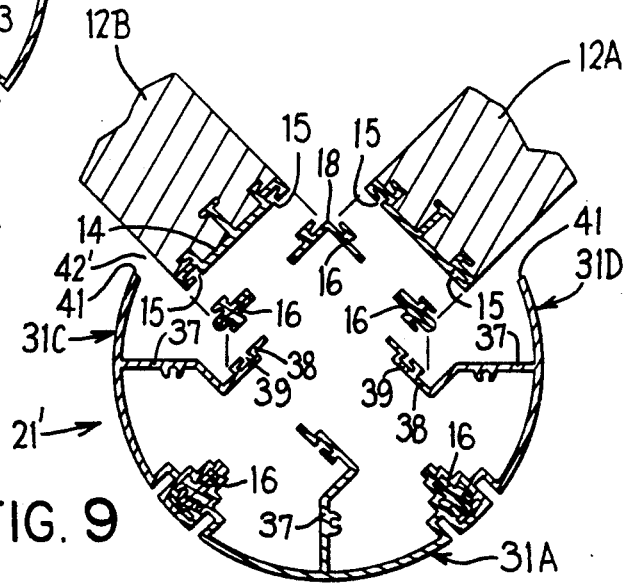
FIG. 9 is a view corresponding to FIG. 8 but showing the posts and panels in a separated condition.

Referring now to the variation illustrated by FIGS. 7-9, this embodiment of the post assembly 13' is designed to cooperate at the corner between two generally perpendicularly-extending panels 12A and 12B.

Referring to FIGS. 8 and 9, the post 21' is in this variation defined by only three post segments, namely the post segments 31A, 31C and 31D, the latter being identical to the respective segments described above with respect to FIGS. 1-6. Since the post 21' includes only a single 90° post segment, namely the segment 31A, this results in the vertically elongated slotlike opening 42', as defined between the opposed free edges 41 of the post segments 31C and 31D, extending through an arcuate extent slightly in excess of 90°. The large horizontal width of this opening 42' enables the edge portions of two perpendicularly extending panels 12A and 12B to project generally inwardly into the interior of the hollow post substantially as illustrated by FIG. 8.

With the post 21', the segments 31C and 31D are again oppositely vertically oriented so that the securing flanges 37 thereof project circumferentially in opposite directions. That is, the flange portions 38 project circumferentially in generally opposite directions, and more specifically are disposed within planes which are generally perpendicular, although the slots 39 are again oriented so as to open generally outwardly through the slots 42'. When the end edge of panel 12A is inserted into the interior of the post, the edge rail 15 on panel 12A is disposed closely adjacent the flange portion 38 on the post segment 31D, and in fact one of the grooves 15 disposed directly opposite the respective groove 39, whereby a first connector or hinge strip 16 is slidably inserted therein to join the panel 12A to the securing flange 37 of the post segment 31D.

In similar fashion, when the edge portion of panel 12B is inserted into the interior of the post, one of the grooves 15 is disposed directly opposite the slot 39 formed in the securing flange 37 of the post segment 31C, and a second identical securing strip or hinge 16 is slidably engaged with these slots to secure the panel 12B to the post segment 31C.

To further rigidly secure the panels to one another and to the posts, a third identical hinge strip 16 is slidably inserted into the remaining grooves 15 as disposed adjacent the abutting corners of the panels 12A and 12B, thereby resulting in a very strong and rigid securement of the panels 12A and 12B to one another and to the post 21', substantially as illustrated by FIG. 8.

With the arrangement of the present invention, by utilizing a first pair of identical post segments 31A and 31B and a further pair of identical post segments 31C and 31D, a rigid hollow post can be created and can be positioned so as to accommodate therein an end portion of a single panel, as illustrated by FIG. 4, with the post segments and the panel being all rigidly joined to one another through the use of identical hinge strips 16, with hinge strips themselves are also usable for joining two such panels directly to one another.

Similarly, by use of the same identical pair of pole segments 31C and 31D, and in conjunction with only a single one of the segments 31A or 31B, the post can be rigidly created and joined to a pair of perpendicularly extending panels, such as illustrated by FIGS. 8 and 9, so that the post defines a corner structure for improving the overall appearance of the wall system, and at the same time providing interior space for electrical cabling or the like. This variation of FIGS. 7-9 again uses all identical hinge strips 16 for directly joining adjacent post segments, for directly joining adjacent post segments and wall panels, and for directly joining adjacent wall panels.

With the improved arrangement of the present invention, the post 21 or 21' is preferably of circular cross section, and preferably has a diameter which is significantly greater than the panel thickness. In fact, the diameter of the post 21 is preferably at least twice the thickness of the typical wall panel and, in the illustrated embodiment, the diameter is about three times the wall panel thickness.

While the hollow tubular post is preferably of circular cross section, it will be recognized that it can also have other cross-sectional configurations, such as square or rectangular. Such hollow tubular post, for example if of a square cross section, would again be formed of post segments which would cooperate with themselves and with one or more panels in the same manner as described above.

The construction of the post segments permits such segments to be readily extruded for the economy of manufacture.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In an upright space divider system including a plurality of horizontally interconnected upright space divider panels, said system also including a post assembly joined to and projecting upwardly along one vertical end edge of at least one said panel, the improvement wherein said post assembly includes:

a hollow upright post extending upwardly along said one end edge of said one panel throughout substantially the full vertical height thereof, said post having a generally tubular outer wall having a cross section which is substantially greater than the width of said one panel;

said post being defined by a plurality of separate vertically elongate post segments which circumferentially cooperate to define the cross section of the post, each said post segment having a peripheral wall segment which defines only part of the outer wall of said post;

securing means including a vertically elongate securing element which is separate from said post segments for joining circumferentially adjacent pairs of post segments together;

each said post segment having a securing flange fixed to the respective peripheral wall segment and projecting inwardly into the interior of the post;

said post having a slotlike opening which opens inwardly thereof through said outer wall and extends vertically throughout substantially the full height thereof;

said one panel begin positioned so that said one end edge thereof projects horizontally through said slotlike opening into the interior of said post; and connecting means disposed interiorly of said post for connecting the one end edge of said one panel to one of said securing flanges, said connecting means including a vertically elognate connecting element which is separate from said post segments and said panel.

2. A system according to claim 1, wherein said tubular post has a diameter which is at least about twice the thickness of the wall panel.

3. A system according to claim 1, wherein said securing and connecting members are of substantially identical cross sections.

4. In an upright space divider system including a plurality of horizontally interconnected upright space divider panels, said system also including a post assembly joined to and projecting upwardly along one vertical end edge of at least one said panel, the improvement wherein said post assembly includes:

a hollow upright post extending upwardly along said one end edge of said one panel throughout substantially the full vertical height thereof, said post having a generally tubular outer wall having a generally circular cross section which is substantially greater than the width of said one panel;

said post being defined by a plurality of separate vertically elongate post segments which circumferentially cooperate to define the cross section of the post, each said post segment having a peripheral wall segment which defines only part of the outer wall of said post, at least two said wall segments each extending through an arcuate extent of about 90°;

securing means for joining circumferentially adjacent pairs of post segments together;

each said post segment having a securing flange fixed to the respective peripheral wall segment and projecting inwardly into the interior of the post;

said post having a slotlike opening which opens inwardly thereof through said outer wall and extends vertically throughout substantially the full height thereof;

said one panel being positioned so that said one end edge thereof projects horizontally through said slotlike opening into the interior of said post; and connecting means disposed interiorly of said post for connecting the one end edge of said one panel to one of said securing flanges.

5. A system according to claim 4 wherein each of said wall segments has a vertically extending edge portion provided along at least one vertical edge thereof, the edge portions on said two post segments being disposed directly adjacent and in generally opposed relationship to one another, each said edge portion having a vertically elongate slot formed therein, and said securing means comprising a vertically elongate securing element slidably received within the slots of the opposed edge portions for rigidly securing said two wall segments in adjacent relationship.

6. A system according to claim 5, wherein the securing flange terminates in a vertically extending edge portion having a vertically elongate slot therein, and said one end edge of said one panel also having a vertically elongate slot formed therein and disposed in close proximity to the slot in said last-mentioned edge portion, and an elongate securing member slidably engaged in the slot of said one panel and the slot of said last-mentioned edge portion for joining said one panel to the securing flange.

7. A system according to claim 6, wherein said securing member and securing element are identical and each includes a pair of vertically elongate securing portions joined together by a hinge portion, each said securing portion begin vertically slidably engage within a respective one of said slots.

8. In an upright space divider system including a plurality of horizontally interconnected upright space divider panels, said system also including a post assembly joined to and projecting upwardly along one vertical end edge of at least one said panel, the improvement wherein said post assembly includes:

a hollow upright post extending upwardly along said one end edge of said one panel throughout substantially the full vertical height thereof, said post having a generally tubular outer wall having a cross section which is substantially greater than the width of said one panel;

said post being defined by a plurality of separate vertically elongate post segments which circumferentially cooperate to define the cross section of the post, each said post segment having a peripheral wall segment which defines only part of the outer wall of said post;

said post includes at least two substantially identical said wall segments which have vertical edges thereof disposed adjacent one another and rigidly joined together by said securing means, each of said two wall segments having a vertically extending edge portion provided along at least one vertical edge thereof, the edge portions on said two post segments being disposed directly adjacent and in generally opposed relationship to one another, each said edge portion having a vertically elongate slot formed therein;

securing means for joining circumferentially adjacent pairs of post segments together, said securing means comprising a vertically elongate securing element slidably received within the slots of the opposed edge portions for rigidly securing said two wall segments in adjacent relationship;

each said post segment having a securing flange fixed to the respective peripheral wall segment and projecting inwardly into the interior of the post;

said post having a slotlike opening which opens inwardly thereof through said outer wall and extends vertically throughout substantially the full height thereof;

said one panel being positioned so that said one end edge thereof projects horizontally through said slotlike opening into the interior of said post; and connecting means disposed interiorly of said post for connecting the one end edge of said one panel to one of said securing flanges.

9. A system according to claim 8, wherein the securing flange terminates in a vertically extending edge portion having a vertically elongate slot therein, and said one end edge of said one panel also having a vertically elongate slot formed therein and disposed in close proximity to the slot in said last-mentioned edge portion, and an elongate securing member slidably engaged in the slot of said panel and the slot of said last-mentioned edge portion for joining said one panel to the securing flange.

10. A system according to claim 9, wherein said securing member and securing element are identical and each includes a pair of vertically elongate securing portions joined together by a hinge portion, each said securing portion being vertically slidably engaged within a respective one of said slots.

11. In an upright space divider system including a plurality of horizontally interconnected upright space divider panels, said system also including a post assembly joined to and projecting upwardly along one vertical end edge of at least one said panel, the improvement wherein said post assembly includes:

a hollow upright post extending upwardly along said one end edge of said one panel throughout substantially the full vertical height thereof, said post having a generally tubular outer wall having a cross section which is substantially greater than the width of said one panel;

said post being defined by a plurality of separate vertically elongate post segments which circumstantially cooperate to define the cross section of the post, each said post segment having a peripheral wall segment which defines only part of the outer wall of said post;

securing means for joining circumstantially adjacent pairs of post segments together;

said post is of a generally circular cross section having a diameter which is substantially greater than the width of said panel, said post including at least four pole segments each defining an arcuate peripheral wall segment which is part of the outer wall of said post, said post segments being disposed in a circular array so that opposed edges of adjacent pole segments are disposed closely adjacent one another and joined together by said securing means;

each said post segment having a securing flange fixed to the respective peripheral wall segment and projecting inwardly into the interior of the post;

said post having a slotlike opening which opens inwardly thereof through said outer wall and extends vertically throughout substantially the full height thereof;

said one panel being positioned so that said one end edge thereof projects horizontally through said slotlike opening into the interior of said post;

said post having only a single said slotlike opening formed therein whereby said post is directly joined to only a single said panel; and connecting means disposed interiorly of said post for connecting the one end edge of said one panel to one of said securing flanges.

12. A system according to claim 11, wherein said post includes at least two said wall segments which are substantially identical and extend through an arcuate extent of about 90°, said two wall segments having adjacent vertical edges joined together by said securing means, said post including a third said wall segment having one vertical edge disposed adjacent and rigidly joined to the remaining vertical edge of one of said two wall segments, said post including a fourth wall segment having a vertical edge disposed adjacent and rigidly joined to the remaining edge of the other of said two wall segments, said third and fourth wall segments extending through arcuate extents less than 90° and having the remaining vertical edges thereof sidewardly spaced apart to define said vertically elongate slotlike opening therebetween.

13. A system according to claim 12, wherein each of said third and fourth wall segments have a said securing flange projecting inwardly thereof, and said connecting means including a pair of connecting members, one said connecting member being connected between the securing flange on the third wall segment and the one end edge of said one panel, the other connecting member being connected between the securing flange on the fourth wall segment and said one end edge of said one panel.

14. In an upright space divider system including a plurality of horizontally interconnected upright space divider panels, said system also including a post assembly joined to and projecting upwardly along one vertical end edge of at least one said panel, the improvement wherein said post assembly includes:

a hollow upright post extending upwardly along said one end edge of said one panel throughout substantially the full vertical height thereof, said post having a generally tubular outer wall having a cross section which is substantially greater than the width of said one panel;

said post being defined by a plurality of separate vertically elongate post segments which circumferentially cooperate to define the cross section of the post, each said post segment having a peripheral wall segment which defines only part of the outer wall of said post;

securing means for joining circumferentially adjacent pairs of post segments together;

each said post segment having a securing flange fixed to the respective peripheral wall segment and projecting inwardly into the interior of the post;

said post having a slotlike opening which opens inwardly thereof through said outer wall and extends vertically throughout substantially the full height thereof;

said one panel begin positioned so that said one end edge thereof projects horizontally through said slotlike opening into the interior of said post;

said vertically elongate slotlike opening extending through an arcuate extent which is in the neighborhood of 90°, said one panel having the one end edge thereof projecting into said slotlike opening horizontally adjacent one side edge thereof;

a second said panel having an end edge thereof positioned so as to project into said slotlike opening horizontally adjacent the other side edge thereof, said one and second panels projecting horizontally in generally perpendicular relationship to one another;

connecting means disposed interiorly of said post for connecting the one end edge of said one panel to one of said securing flanges, said connecting means also connecting one of said securing flanges to said end edge of said second panel; and connecting structure for horizontally securing the said end edges of said one and second panels directly together.

* * * * *

UNITED STATES PATENT AND TRADEMARK OFFICE

CERTIFICATE OF CORRECTION

PATENT NO. : 5 150 554

DATED : September 29, 1992

INVENTOR(S) : Roger J. Quinlan, Jr. et al

It is certified that error appears in the above-identified patent and that said Letters Patent is hereby corrected as shown below:

Column 1, line 14; after "space" insert ---divider---.

Column 2, line 37; delete the comma.

Column 3, line 18; change "induce" to ---includes---.

Column 8, line 27; after "4" insert a comma.
after "said" insert ---two---.

Signed and Sealed this

Eighth Day of February, 1994

Bruce Lehman

*Attest:*

BRUCE LEHMAN

*Attesting Officer*

*Commissioner of Patents and Trademarks*